US007893809B2

(12) United States Patent
Head

(10) Patent No.: US 7,893,809 B2
(45) Date of Patent: Feb. 22, 2011

(54) SERVICE DISCONNECT ASSEMBLY FOR A HIGH VOLTAGE ELECTRONIC MODULE

(75) Inventor: James Alan Head, Romeo, MI (US)

(73) Assignee: Tyco Electronics Corporation, Berwyn, PA (US)

( * ) Notice: Subject to any disclaimer, the term of this patent is extended or adjusted under 35 U.S.C. 154(b) by 182 days.

(21) Appl. No.: 12/389,250

(22) Filed: Feb. 19, 2009

(65) Prior Publication Data

US 2010/0207717 A1 Aug. 19, 2010

(51) Int. Cl.
*H01H 85/25* (2006.01)
*H01H 85/54* (2006.01)
*H01R 13/62* (2006.01)

(52) U.S. Cl. ..... 337/194; 337/196; 337/205; 337/211; 361/626; 361/642; 361/646; 361/837; 439/620.26; 439/620.29; 439/620.34; 439/620.3; 439/893

(58) Field of Classification Search ..... 337/194, 337/196, 205, 211; 361/642, 626, 646, 837; 439/157, 620.26, 620.29, 620.34, 893, 620.3
See application file for complete search history.

(56) References Cited

U.S. PATENT DOCUMENTS 1,966,716 A * 7/1934 Green ..... 337/194
2,072,729 A * 3/1937 Corbett ..... 337/196
2,186,813 A * 1/1940 Frederick et al. ..... 337/210
2,289,122 A * 7/1942 Jackson et al. ..... 337/188
3,030,474 A * 4/1962 Scott, Jr. ..... 337/7
3,202,788 A * 8/1965 George ..... 337/194
3,358,100 A * 12/1967 Schleicher ..... 337/194
3,379,842 A * 4/1968 Downs et al. ..... 337/146
4,778,959 A * 10/1988 Sabatella et al. ..... 218/1
4,851,963 A * 7/1989 Miller et al. ..... 361/643
4,966,561 A * 10/1990 Norden ..... 439/620.34
5,406,449 A * 4/1995 Hicks et al. ..... 361/616
5,559,662 A * 9/1996 Happ et al. ..... 361/104
5,831,228 A * 11/1998 Kuki et al. ..... 200/16 E
5,833,484 A * 11/1998 Post et al. ..... 439/352

(Continued)

FOREIGN PATENT DOCUMENTS

DE 102007053535 * 5/2009

(Continued)

*Primary Examiner*—Anatoly Vortman

(57) ABSTRACT

A service disconnect assembly for an electronic module includes a fuse carrier having a holder configured to hold a fuse for the electronic module, where the fuse carrier has an attachment finger extending from the holder. The attachment finger has a peg. The service disconnect assembly also includes a service disconnect cover having a hood forming a channel, with the hood having a window exposing a portion of the channel. The attachment finger is received in the channel to couple the fuse carrier to the service disconnect cover. The service disconnect cover is slidable with respect to the fuse carrier between an initial position and a final position, wherein the hood moves with respect to the attachment finger as the service disconnect cover is moved between the initial and final positions. The peg is aligned with the window in the final position. A handle is rotatably coupled to the service disconnect cover and the handle has a catch aligned with the window. The handle is movable to a locked position wherein the catch blocks the peg to prevent relative movement between the service disconnect cover and the fuse carrier.

20 Claims, 8 Drawing Sheets

U.S. PATENT DOCUMENTS 5,842,560 A * 12/1998 Kuki et al. ..... 200/43.05
5,847,338 A * 12/1998 Kuki et al. ..... 200/17 R
5,973,418 A * 10/1999 Ciesielka et al. ..... 307/130
6,157,287 A * 12/2000 Douglass et al. ..... 337/198
6,317,312 B1 * 11/2001 Hashizawa et al. ..... 361/642
6,325,647 B1 * 12/2001 May et al. ..... 439/157
6,333,846 B1 * 12/2001 Hashizawa et al. ..... 361/649
6,366,449 B1 * 4/2002 Hashizawa et al. ..... 361/642
6,407,656 B1 * 6/2002 Konda et al. ..... 337/194
6,587,028 B2 * 7/2003 Mollet et al. ..... 337/194
6,650,222 B2 * 11/2003 Darr et al. ..... 337/187
6,717,505 B1 * 4/2004 Bruchmann ..... 337/194
6,727,797 B1 * 4/2004 Bruchmann ..... 337/210
6,736,655 B2 * 5/2004 Martin et al. ..... 439/157
6,784,783 B2 * 8/2004 Scoggin et al. ..... 337/194
6,853,289 B2 * 2/2005 Scoggin ..... 337/194
6,997,725 B2 * 2/2006 Stella et al. ..... 439/157
6,998,954 B2 * 2/2006 Milanczak ..... 337/194
7,355,503 B2 * 4/2008 Buettner ..... 337/211
7,474,194 B2 * 1/2009 Darr et al. ..... 337/72
7,561,017 B2 * 7/2009 Darr et al. ..... 337/79
7,750,789 B2 * 7/2010 Titokis et al. ..... 337/194
2003/0199184 A1 * 10/2003 Martin et al. ..... 439/157
2005/0098419 A1 * 5/2005 Matsui et al. ..... 200/311
2008/0242150 A1 * 10/2008 Chikamatsu et al. ..... 439/620.3
2009/0246992 A1 * 10/2009 Martin ..... 439/157

FOREIGN PATENT DOCUMENTS

FR 2877138 A1 * 4/2006

* cited by examiner

SERVICE DISCONNECT ASSEMBLY FOR A HIGH VOLTAGE ELECTRONIC MODULE

BACKGROUND OF THE INVENTION

The subject matter herein relates generally to service disconnect assemblies, and more particularly, to service disconnect assemblies for electronic modules.

High voltage electronic modules are used as power supplies, such as battery packs for automotive applications. The electronic modules typically include a fuse system with a service disconnect assembly for removing the fuse. The service disconnect assembly removes the fuse from the electronic module to protect an operator or technician when servicing or repairing the electronic module. The service disconnect assembly includes a fuse holder that holds the fuse. As the service disconnect assembly is mated to the electronic module, the fuse is loaded into a fuse chamber of the electronic module.

Electronic modules having fuse systems are not without disadvantages. For instance, the service disconnect assemblies are typically mated with the electronic module by loading the service disconnect module in a loading direction and then latching the service disconnect module to the electronic module using a latch. The service disconnect assemblies are removed from the electronic module in an opposite direction and may be inadvertently removed from the fuse chamber, such as when the latch is not properly latched or unintentionally unlatched. To overcome the problem of inadvertent removal, at least some known service disconnect assemblies include multi-step latching, such as by incorporating sliding of the service disconnect assembly in a sliding direction after the fuse is loaded into the fuse chamber.

A need remains for a service disconnect assembly that allows a technician or operator to safely couple a fuse to an electronic module. A need remains for a service disconnect assembly that avoids unintentional removal from the electronic module. A need remains for a service disconnect assembly that allows a technician or operator to safely uncouple the fuse from the electronic module.

BRIEF DESCRIPTION OF THE INVENTION

In one embodiment, a service disconnect assembly is provided for an electronic module and includes a fuse carrier having a holder configured to hold a fuse for the electronic module, where the fuse carrier has an attachment finger extending from the holder. The attachment finger has a peg. The service disconnect assembly also includes a service disconnect cover having a hood forming a channel, with the hood having a window exposing a portion of the channel. The attachment finger is received in the channel to couple the fuse carrier to the service disconnect cover. The service disconnect cover is slidable with respect to the fuse carrier between an initial position and a final position, wherein the hood moves with respect to the attachment finger as the service disconnect cover is moved between the initial and final positions. The peg is aligned with the window in the final position. A handle is rotatably coupled to the service disconnect cover and the handle has a catch aligned with the window. The handle is movable to a locked position wherein the catch blocks the peg to prevent relative movement between the service disconnect cover and the fuse carrier.

Optionally, at least a portion of the handle may be received in the channel through the window when the handle is in the locked position. The peg may extend from the attachment finger and include a first end and a second end with the catch engaging the second end to prevent movement of the service disconnect cover in a direction from the final position to the initial position. The catch may engage the first end to prevent movement of the service disconnect cover to the final position when the handle is in the locked position. The service disconnect cover may be movable in a linear sliding direction relative to the fuse carrier, with the catch being aligned with the peg in the sliding direction when the catch is in the locked position. Optionally, the channel may extend longitudinal between opposed first and second ends, with the attachment finger positioned proximate to the second end when the service disconnect cover is in the initial position, and the attachment finger being positioned proximate to the first end when the service disconnect cover is in the final position.

In another embodiment, a service disconnect assembly for an electronic module is provided including a fuse carrier having a holder configured to hold a fuse for the electronic module, with the fuse carrier being receivable in a fuse chamber of the electronic module to electrically connect the fuse with the electronic module. The fuse carrier has alignment fingers each having a tip and a catch surface extending from the alignment fingers and positioned a distance from the respective tip. The tips of the alignment fingers being configured to engage ramp surfaces in the fuse chamber to flex the tips from a blocking position to a clearance position, with the alignment fingers engaging the ramp surfaces as the fuse carrier is loaded into the fuse chamber. The service disconnect assembly also includes a service disconnect cover having an end wall with the fuse carrier being coupled to the service disconnect cover. The service disconnect cover is slidable with respect to the fuse carrier between an initial position and a final position, wherein the catch surfaces of the alignment fingers catch the end wall to block movement of the service disconnect cover from the initial position to the final position when the tips are in the blocking position, and wherein the end wall is configured to clear the catch surfaces with the tips are in the clearance position.

In a further embodiment, a service disconnect assembly for an electronic module is provided including a module cover having a fuse chamber defined by chamber walls that has an opening providing access to the fuse chamber. The module cover includes a locking feature extending into the fuse chamber from a respective chamber wall with the locking feature including a ramp facing away from the opening and forming a detention area. The service disconnect assembly includes a fuse carrier having a holder configured to hold a fuse for the electronic module and the fuse carrier is received in the fuse chamber to electrically connect the fuse with the electronic module. The service disconnect assembly also includes a service disconnect cover having a mounting block where the fuse carrier is coupled to the mounting block. The mounting block includes a locking finger extending from the mounting block. The service disconnect cover is positioned adjacent the module cover such that the locking finger engages the locking feature. The service disconnect cover is movable with respect to the module cover between an initial position and a final position, wherein the locking finger slides along the ramp surface toward the detention area as the service disconnect cover is moved from the initial position to the final position. The locking finger is captured in the detention area by the ramp when the service disconnect cover is in the final position.

DETAILED DESCRIPTION OF THE INVENTION

Figure 1:
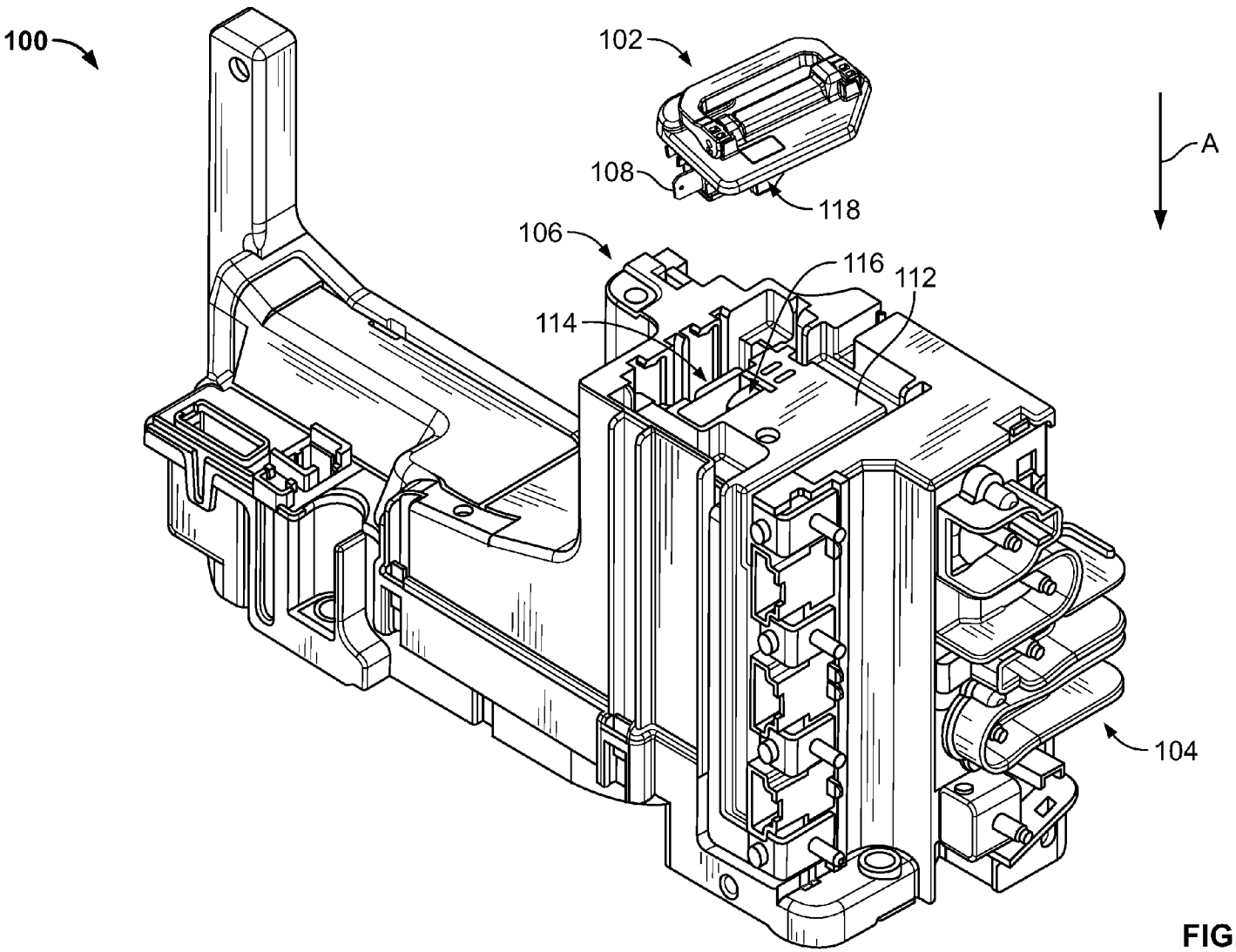
FIG. 1 is a perspective view of an electronic module having a service disconnect assembly.

FIG. 1 is a perspective view of an electronic module 100 having a service disconnect assembly 110. In the illustrated embodiment, the electronic module 100 represents a high voltage power supply, such as a battery pack for an automotive application. The battery pack in the illustrated embodiment is one exemplary embodiment of a component utilizing a fuse system having a service disconnect feature. The subject matter described herein is not intended to be limited to automotive battery packs.

The electronic module 100 includes a plurality of terminals 104. The electronic module 100 also includes a fuse system 106 for protecting the electronic module 100 and/or for protecting service personnel during repair and/or maintenance. The fuse system 106 has a fuse 108 that is configured to be electrically connected to at least one of the terminals 104. The service disconnect assembly 110 is utilized for loading and unloading the fuse 108. For example, when the service disconnect assembly 100 is properly mated and/or locked in position with respect to the electronic module 100, the fuse 108 is connected to the terminals 104 to complete a circuit. The service disconnect assembly 110 removes the fuse 108 from the electronic module 100 to protect an operator or technician when servicing or repairing the electronic module 100.

The electronic module 100 includes a module cover 112 proximate the terminals 104. The module cover 112 includes a fuse chamber 114 that receives the fuse 108. The fuse 108 is electrically connected to at least one of the terminals 104 when the fuse 108 is loaded into the fuse chamber 114. In an exemplary embodiment, the module cover 112 also includes a high voltage interlock 116. The service disconnect assembly 110 includes a corresponding high voltage interlock 118 that connects to the high voltage interlock 116 of the module cover 112 to complete an interlock circuit. For example, when the service disconnect assembly 110 is properly mated and/or locked in position with respect to the module cover 112, the high voltage interlocks 116, 118 are connected to one another to complete the interlock circuit.

During assembly, the service disconnect assembly 110 is mated with the module cover 112 in a loading direction, shown in FIG. 1 by an arrow A. For example, the fuse 108 is aligned with the fuse chamber 114 and the service disconnect assembly 110 loads the fuse 108 into the fuse chamber 114. In an exemplary embodiment, the service disconnect assembly 110 utilizes multi-step mating by incorporating a sliding action of the service disconnect assembly 110 in a sliding direction after the fuse 108 is loaded into the fuse chamber 114 to lock the service disconnect assembly 110 with respect to the module cover 112. The multi-step mating will be described in further detail below.

In an exemplary embodiment, the service disconnect assembly 110 includes at least one position assurance feature as a safety feature. For example, the service disconnect assembly 110 may include features to ensure that the fuse 108 is properly positioned with respect to the fuse chamber 114. Additionally, or alternatively, the service disconnect assembly 110 may include features to ensure that the service disconnect assembly 110 is properly positioned with respect to the fuse 108. Additionally, or alternatively, the service disconnect assembly 110 may include features to ensure that the service disconnect assembly 110 is locked or otherwise secured in position with respect to the fuse 108 and/or the module cover 112.

Figure 2:
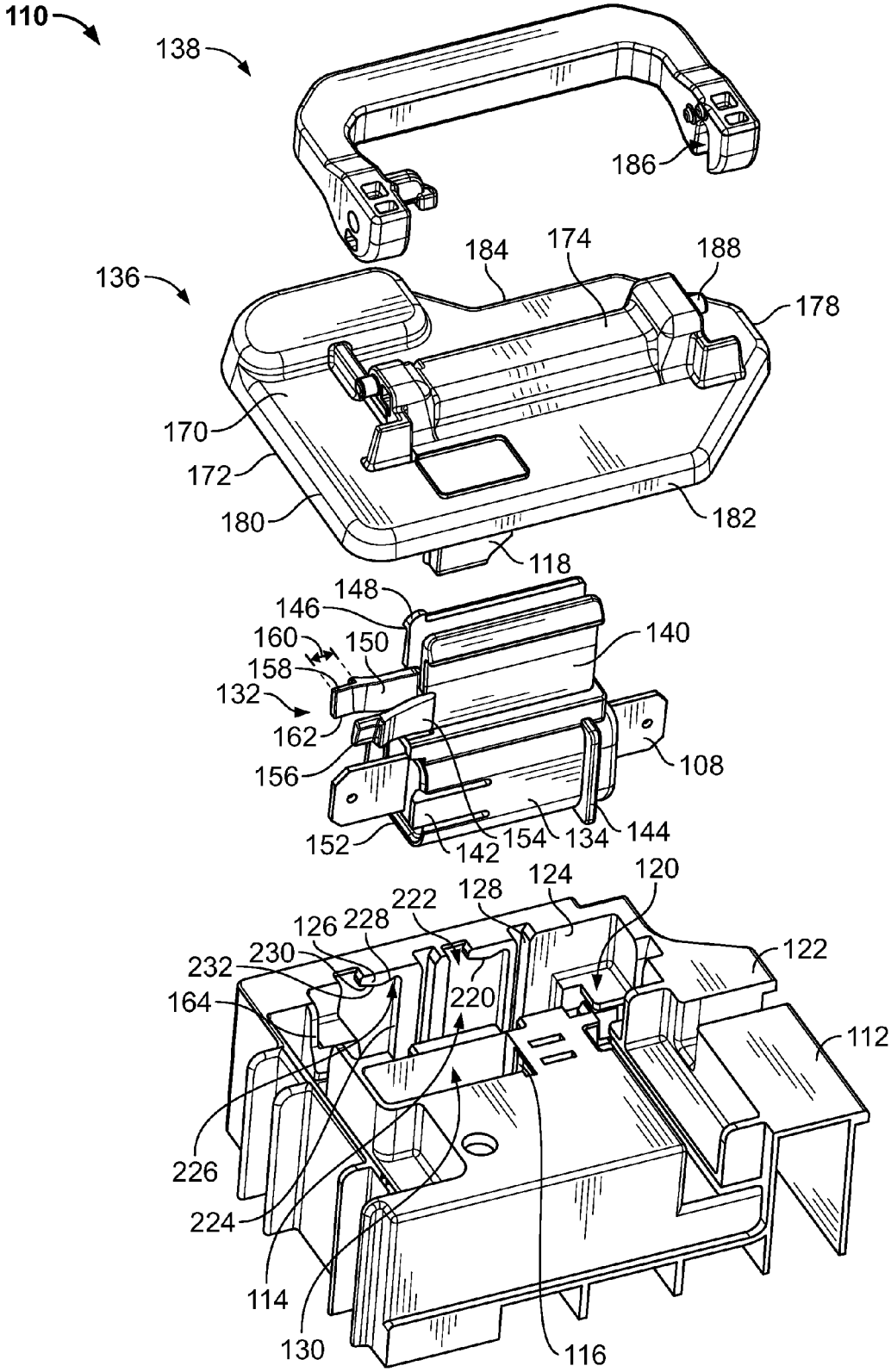
FIG. 2 is an exploded view of the service disconnect assembly and module cover shown in FIG. 1.

FIG. 2 is an exploded view of the service disconnect assembly 110 and module cover 112. The module cover 112 has an opening 120 in an outer surface 122 of the module cover 112 that provides access to the fuse chamber 114. The fuse chamber 114 is defined by a plurality of chamber walls 124 extending generally perpendicularly from the outer surface 122. The module cover 112 includes a plurality of locking features 126 extending into the fuse chamber 114 from the chamber walls 124. The locking features 126 are used to secure the service disconnect assembly 110 to the module cover 112, as will be explained in further detail below. In an exemplary embodiment, alignment channels 128 are formed in the chamber walls 124 to align the service disconnect assembly 110 with the fuse chamber 114 during assembly.

In an exemplary embodiment, the module cover 112 includes an interlock chamber 130 exposing the high voltage interlock 116. The interlock chamber 130 is configured to receive the high voltage interlock 118 of the service disconnect assembly 110 during assembly.

The service disconnect assembly 110 includes a fuse carrier 132 having a holder 134 configured to hold the fuse 108. The service disconnect assembly 110 also includes a service disconnect cover 136 and a handle 138 coupled to the service disconnect cover 136. The fuse carrier 132 is coupled to the service disconnect cover 136 prior to being coupled to the module cover 112 as a unit. In an exemplary embodiment, the service disconnect cover 136 is movable with respect to the fuse carrier 132 after the unit is coupled to the module cover 112 to provide multi-step latching. For example, the service disconnect cover 136 may be slidable along the module cover 112 while the fuse 108 is held in place within the fuse chamber 114.

The fuse carrier 132 includes the holder 134 and a plurality of attachment fingers 140 extending from the holder 134. In an exemplary embodiment, the holder 134 has a generally rectangular cross-section that defines a space for the fuse 108. The fuse 108 is loaded into the space defined by the holder 134 and held therein by latches 142. The holder 134 may have any shape depending on the shape of the fuse 108. The holder 134 has alignment ribs 144 extending therefrom that are received in the alignment channels 128 in the module cover 112 to align the fuse carrier 132 with the fuse chamber 114. Optionally, the alignment ribs 144 may be positioned to provide polarization or keying to properly orient the fuse carrier 132 within the fuse chamber 114. For example, in an exemplary embodiment, one side of the fuse carrier 132 includes a single alignment rib 144 and the other side of the fuse carrier 132 includes two alignment ribs 136.

The attachment fingers 140 extend from the holder 134. In an exemplary embodiment, the attachment fingers 140 are latches having a latching surface 146 generally facing the holder 134 when assembled. The latching surfaces 146 engage a portion of the service disconnect cover 136 to secure the attachment fingers 140 to the service disconnect cover 136. The attachment fingers 140 may be slidably coupled to the service disconnect cover 136 such that the service disconnect cover 136 is capable of moving with respect to the attachment fingers 140 while the attachment fingers 140 are coupled to the service disconnect cover 136. In an exemplary embodiment, the attachment fingers 140 are deflectable toward one another, such as during mating with the service disconnect cover 136. At least one of the attachment fingers 140 includes a peg 148. As will be described in further detail below, the peg 148 may be used as a position assurance feature to ensure that the fuse carrier 132 is properly positioned with respect to the service disconnect cover 136.

In an exemplary embodiment, the fuse carrier 132 includes a plurality of alignment fingers 150 extending from a rear 152 of the holder 134 and/or the attachment fingers 140. As described in further detail below, the alignment fingers 150 may be used as a position assurance feature to ensure that the fuse carrier 132 is properly positioned within the fuse chamber 114. The alignment fingers 150 include beams 154 that extend to tips 156. The alignment fingers 150 also include rear facing catch surfaces 158 that extend outward, generally perpendicularly from the beams 154. In the illustrated embodiment, the catch surfaces 158 extend outward away from one another. Alternatively, the catch surfaces 158 may extend inward toward one another in alternative embodiments. In the illustrated embodiment, the catch surfaces 158 are axially aligned with one another along the beams 154, however the catch surfaces 158 need not be aligned in other embodiments. The catch surfaces 158 face generally rearward toward the tips 156 and away from the holder 134. The catch surfaces 158 are positioned a distance 160 from the tips 156 such that the tips 156 extend rearward beyond the catch surfaces 158.

In an exemplary embodiment, a bottom 162 of each tip 156 is angled inward. The tips 156 are configured to engage ramp surfaces 164 of the module cover 112. The ramp surfaces 164 are provided at a rear of the fuse chamber 114. As described in further detail below, the alignment fingers 150 are deflected by the ramp surfaces 164 from a blocking position to a clearance position during loading of the fuse 108 into the fuse chamber 114. In the illustrated embodiment, the alignment fingers 150 are deflected inward by the ramp surfaces 164, however the alignment fingers 150 may be deflected outward in alternative embodiments. The alignment fingers 150 are initially and normally splayed outward with respect to one another from the fixed ends of the beams 154 to the tips 156. When the alignment fingers 150 engage the ramp surfaces 164, the alignment fingers 150 are flexed inward toward one another, such as to a position in which the beams 154 are generally parallel to one another. When the alignment fingers 150 are deflected and moved, the catch surfaces 158 are similarly deflected and moved from a blocking position to a clearance position.

The service disconnect cover 136 includes an exterior surface 170 and an interior surface 172. The exterior surface 170 is exposed to the surrounding or external environment when the service disconnect assembly 110 is coupled to the module cover 112. The interior surface 172 generally faces the module cover 112 when the service disconnect cover 136 is coupled to the module cover 112. The service disconnect cover 136 has a hood 174 that forms an internal channel 176 (shown in FIG. 4). In an exemplary embodiment, the attachment fingers 140 are received in the channel 176 to coupled the fuse carrier 132 to the service disconnect cover 136. The service disconnect cover 136 has a front 178 and a rear 180, and includes opposed sides 182, 184 extending between the front 178 and rear 180.

The handle 138 is coupled to the exterior surface 170 of the service disconnect cover 136. Optionally, the handle 138 may be coupled to the opposite ends of the hood 174. In the illustrated embodiment, the handle 138 includes slots 186 that receive pins 188 extending from the service disconnect cover 136. The pins 188 are secured in the slots 186, such as by a snap-fit. The handle 138 is rotatably coupled to the service disconnect cover 136, such as by rotating about the pins 188. In an exemplary embodiment the handle 138 is rotatable between a locked position and an unlocked position. The handle 138 may be coupled to the service disconnect cover 136 by alternative means in alternative embodiments.

In an exemplary embodiment, the high voltage interlock 118 extends from the interior surface 172 of the service disconnect cover 136. The high voltage interlock 118 may be positioned proximate one of the sides 182.

Figure 3:
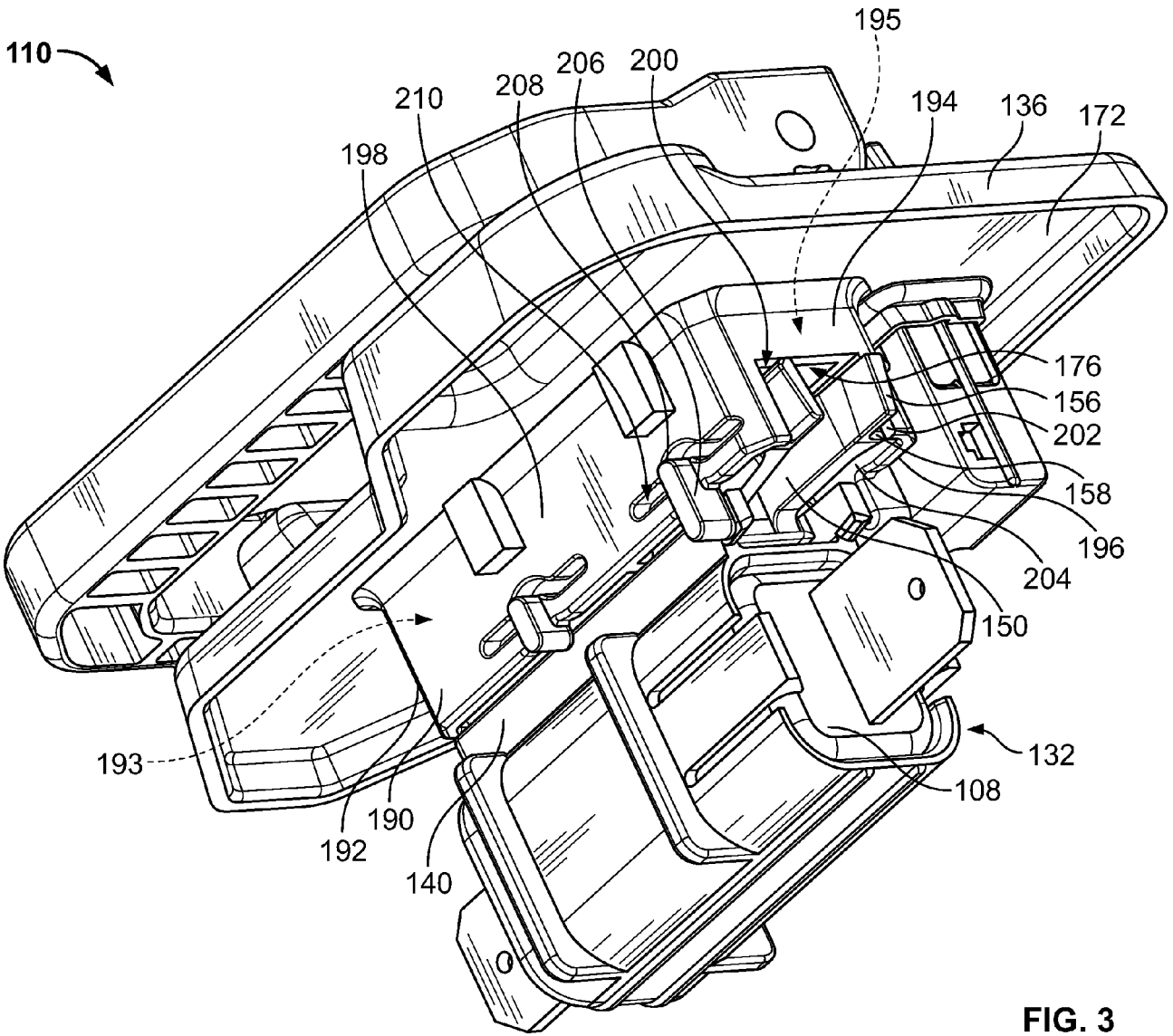
FIG. 3 is an assembled bottom perspective view of the service disconnect assembly.

FIG. 3 is an assembled bottom perspective view of the service disconnect assembly 110. FIG. 3 illustrates a mounting block 190 of the service disconnect cover 136. The mounting block 190 extends downward from the interior surface 172 and has a hollow interior, at least a portion of which is formed by the channel 176. The mounting block 190 receives the fuse carrier 132 during assembly. The mounting block 190 includes a front end wall 192 that is generally forward facing and that defines a first end 193 of the channel 176. The mounting block 190 also includes a rear end wall 194 that is generally rearward facing and that defines a second end 195 of the channel 176. The mounting block 190 also includes opposed side walls 196, 198 that extend between the end walls 192, 194. The rear end wall 194 includes an opening 200 therethrough defined by opposed edges 202.

When the fuse carrier 132 is loaded into the mounting block 190, the attachment fingers 140 extend into the hollow interior of the mounting block 190 and at least partially into the channel 176. In the initially loaded position, the attachment fingers 140 are positioned proximate to the first or forward end 193 of the channel 176. When the fuse carrier is moved (e.g. slid or transferred forwardly) with respect to the fuse carrier 132, the attachment fingers 140 are positioned proximate to the second or rear end 195 of the channel 176.

When the fuse carrier 132 is loaded into the mounting block 190, the alignment fingers 150 extend through the opening 200 to the outside of the mounting block 190. As such, at least a portion of the alignment fingers 150 are positioned inside the mounting block 190 and at least a portion of the alignment fingers 150 are positioned outside the mounting block 190. When the fuse carrier 132 is initially loaded into the mounting block 190, the catch surfaces 158 of the alignment fingers 150 engage an interior 204 of the mounting block 190 and the tips 156 engage the edges 202. In the initial position, the alignment fingers 150 are in a blocking position and block movement (e.g. sliding) of the service disconnect cover 136 with respect to the fuse carrier 132. However, when the alignment fingers 150 are moved to the clearance position, such as when the fuse carrier 132 is loaded into the fuse chamber 114 (shown in FIG. 2) and the alignment-fingers 150 engage the ramp surfaces 164 (shown in FIG. 2), the service disconnect cover 136 is movable with respect to the fuse carrier 132. For example, in the clearance position, the catch surfaces 158 no longer block or engage the rear end wall 194.

Rather, the catch surfaces 158 are cleared to fit through the opening 200 as the service disconnect cover 136 is moved in a generally forward direction.

The service disconnect cover 136 includes a plurality of locking fingers 206. The locking fingers 206 may be used as a position assurance feature to ensure that the service disconnect cover 136 is coupled to the module cover 112. The locking fingers 206 extend outward from the side walls 196 and/or 198. In an exemplary embodiment, the locking fingers 206 include curved top surfaces 208 and are generally elongated from top to bottom. In an exemplary embodiment, the side walls 196 and/or 198 include a slot 210 adjacent the locking finger 206. The slots 210 provide flexibility and allow the locking fingers 206 to deflect in a direction along the longitudinal axis of the locking finger 206. The locking fingers 206 may be deflected in a flexing direction that is generally perpendicular to the direction of movement of the service disconnect cover 136 as the service disconnect cover 136 is moved from the initial position to the final position. In the illustrated embodiment, two locking fingers 206 are shown on the side wall 198. Any number of locking fingers 206 may be provided. The side wall 196 may include the same number of locking fingers 206, a different number of locking fingers 206, and may even have no locking fingers 206. Optionally, the locking fingers 206 may be sized and/or shaped differently. The locking fingers 206 may be provided at different vertical positions with respect to the interior surface 172 of the service disconnect cover 136. In an exemplary embodiment, the top surfaces 208 of the locking fingers 206 are vertically aligned with one another.

With reference back to FIG. 2 and FIG. 3, an exemplary locking operation is described for locking the service disconnect cover 136 to the module cover 112. The locking fingers 206 of the service disconnect cover 136 cooperate with the locking features 126 of the module cover 112 to secure the service disconnect cover 136 to the module cover 112 when the service disconnect cover 136 is slid to the final position.

As illustrated in FIG. 2, each locking feature 126 includes a ramp 220 facing away from the opening 120. An opening 222 is formed in the module cover 112 adjacent the ramp 220 and the locking finger 206 is loaded through the opening 222 when the service disconnect cover 136 is mated with the module cover 112. The ramp 220 cooperates with a front wall 224 to form a detention area 226. The detention area 226 is configured to detain the corresponding locking finger 206 to lock the service disconnect cover 136 in the final position. The detention area 226 restricts removal of the service disconnect cover 136 by pulling the service disconnect cover 136 upward away from the module cover 112. Rather, to remove the service disconnect cover 136, the service disconnect cover 136 is moved rearward from the final position to the initial position, where the locking fingers 206 are aligned with the openings 222 to remove. In the initial position, the service disconnect cover 136 may be lifted upward, thus removing the fuse 108 from the fuse chamber 114.

In an exemplary embodiment, the ramp 220 includes first and second ramp surfaces 228, 230 meeting at a peak 232. Optionally, the peak 232 may be curved. The first ramp surface 228 is generally forward facing and the second ramp surface 230 is generally rearward facing. The locking finger 206 rides along the ramp surfaces 228, 230 as the service disconnect cover 136 is moved between the initial and final positions. The locking finger 206 initially engages the ramp surface 230 as the service disconnect cover 136 is moved from the initial position to the final position. The locking finger 206 initially engages the ramp surface 228 as the service disconnect cover 136 is moved from the final position to the initial position. Optionally, the top surface 208 of the locking finger 206 engages the ramp 220 as the service disconnect cover 136 is slid between the initial and final positions. The locking finger 206 moves along the ramp 220 in a first or forward direction as the service disconnect cover 136 is moved from the initial position to the final position. The locking finger 206 moves along the ramp 220 in a second or rearward direction as the service disconnect cover 136 is moved from the final position to the initial position. In an exemplary embodiment, the locking feature 126 and the locking finger 206 define a bi-stable lock to ensure that the service disconnect cover 136 is in either the initial position or the final position. The locking feature 126 and the locking finger 206 do not allow the service disconnect cover 136 to rest in a position other than the initial position or the final position, such as along the ramp 220, with the ramp surfaces 228, 230 forcing the locking finger 206 in one direction or the other direction. The ramp surfaces 228, 230 force the locking finger 206 along the respective ramp surface 228, 230 away from the peak 232 in the absence of a force or active movement by an operator in the direction of either the initial position or the final position.

Figure 4:
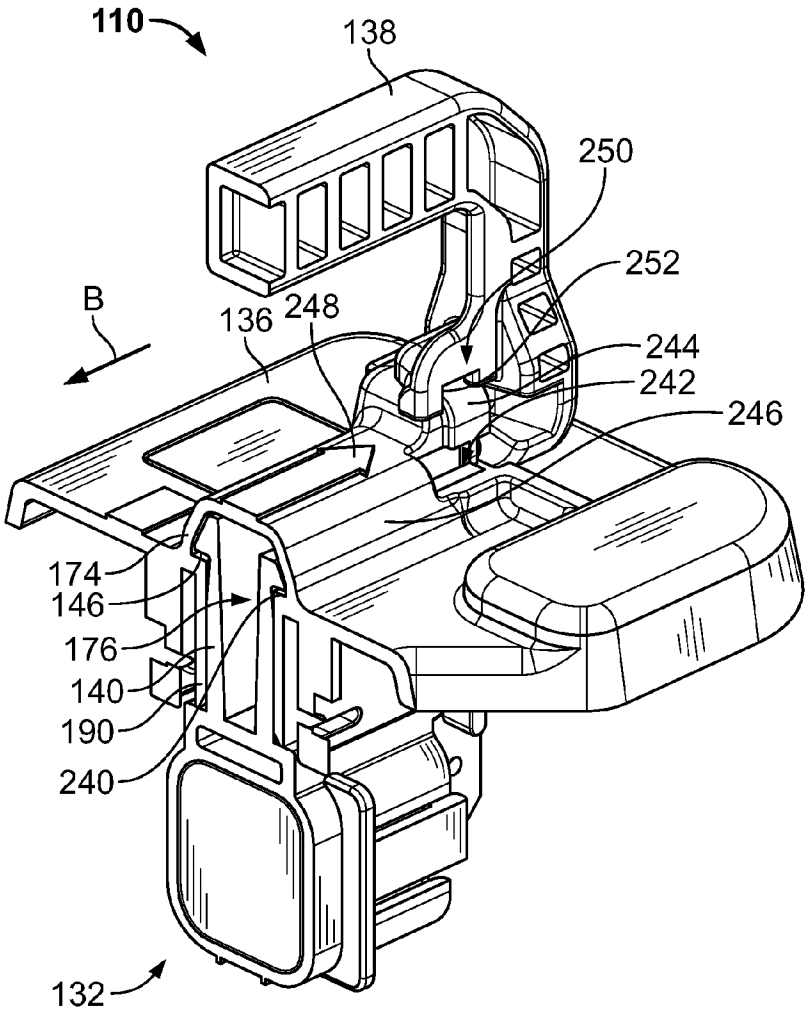
FIG. 4 is a partial cut-away view of the service disconnect assembly in an unlocked position.

FIG. 4 is a partial cut-away view of the service disconnect assembly 110 in an unlocked position. FIG. 4 illustrates the fuse carrier 132 coupled to the service disconnect cover 136. In the position illustrated in FIG. 4, the service disconnect cover 136 is in the initial position (e.g. in a position prior to sliding) relative to the fuse carrier 132.

The attachment fingers 140 extend into the mounting block 190 such that the ends of the attachment fingers 140 are received in the channel 176 of the hood 174. Optionally, the channel 176 may extend at least partially into the mounting block 190. In an exemplary embodiment, the latching surfaces 146 of the attachment fingers 140 engage a shoulder 240 of the channel 176 that defines a catch surface. The fuse carrier 132 is vertically held in position with respect to the service disconnect cover 136 by the attachment fingers 140. As described above, the service disconnect cover 136 is slidable with respect to the fuse carrier 132, and the shoulder 240 is configured to slide horizontally relative to the attachment fingers 140 while maintaining the vertical position of the fuse carrier 132 with respect to the service disconnect cover 136.

In an exemplary embodiment, the service disconnect cover 136 includes a window 242 in the hood 174. The window 242 exposes a portion of the channel 176. In the illustrated embodiment, the window 242 is located proximate to a rear end 244 of the hood 174. The window 242 is located along a side 246 and a top 248 of the hood 174. In the illustrated position, the attachment fingers 140 are positioned forward of the window 242 such that the attachment fingers 140 are not aligned with the window 242 and the attachment fingers 140 are not exposed by the window 242. In alternative embodiments, in the initial position, at least a portion of the attachment fingers 140 may be aligned and/or exposed by the window 242.

Figure 6:
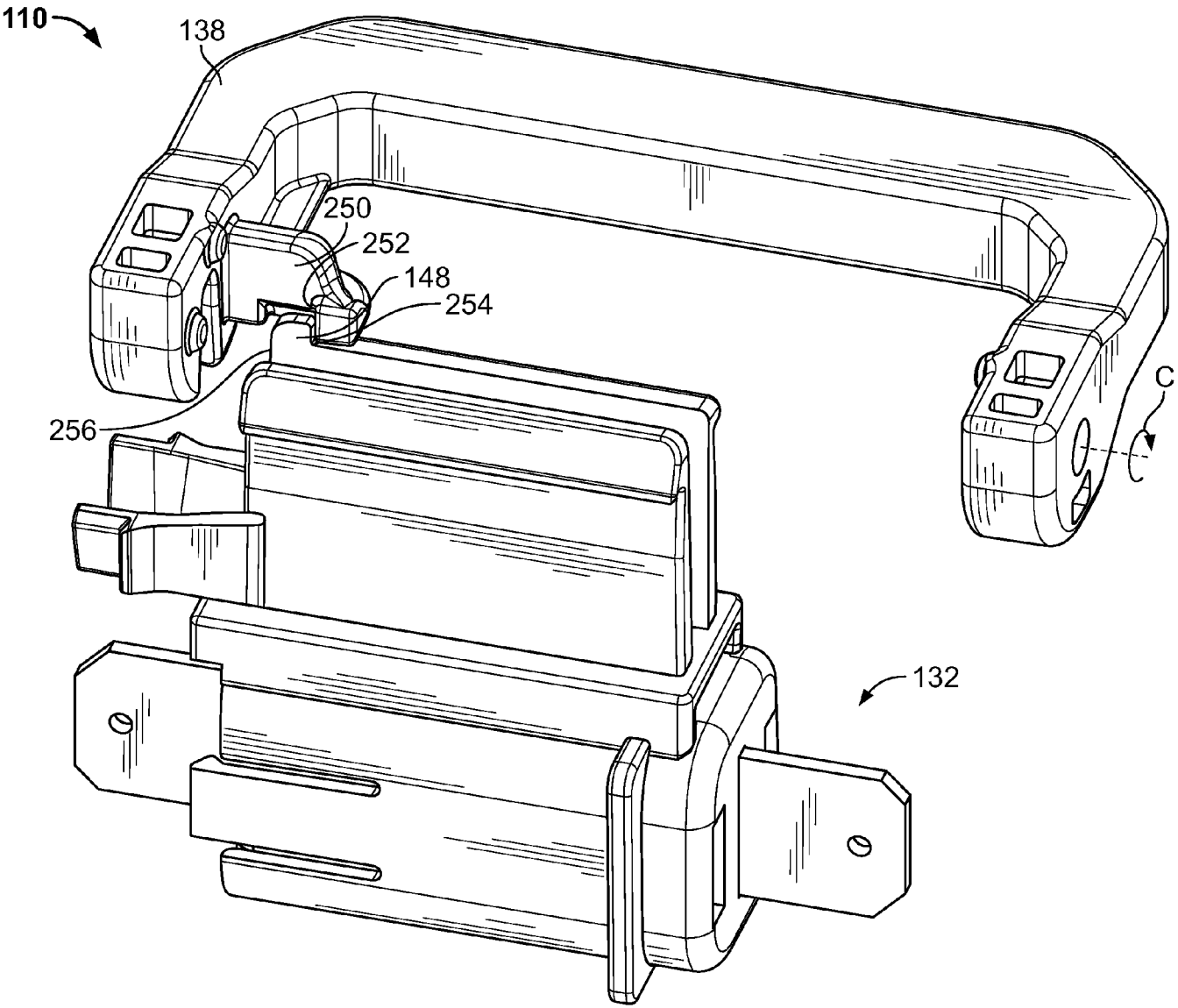
FIG. 6 is a perspective view of a portion of the service disconnect assembly with the service disconnect cover removed and with a handle thereof in a locked position.

The handle 138 is rotatably coupled to the service disconnect cover 136 and is movable between an unlocked position, such as the position illustrated in FIG. 4, and a locked position, such as the position illustrated in FIG. 6. In an exemplary embodiment, the handle 138 includes a catch 250 aligned with the window 242. The catch 250 may be an opening or chamber having at least one finger engagement surface 252. When the handle 138 is rotated from the unlocked position to the locked position, the catch 250 is moved toward the window 242 and substantially closes the window 242. The catch 250 functions as a lid that closes access to the window 242.

Optionally, at least a portion of the catch 250 is received in the channel 176 through the window 242 when the handle 138 is moved to the locked position.

Figure 5:
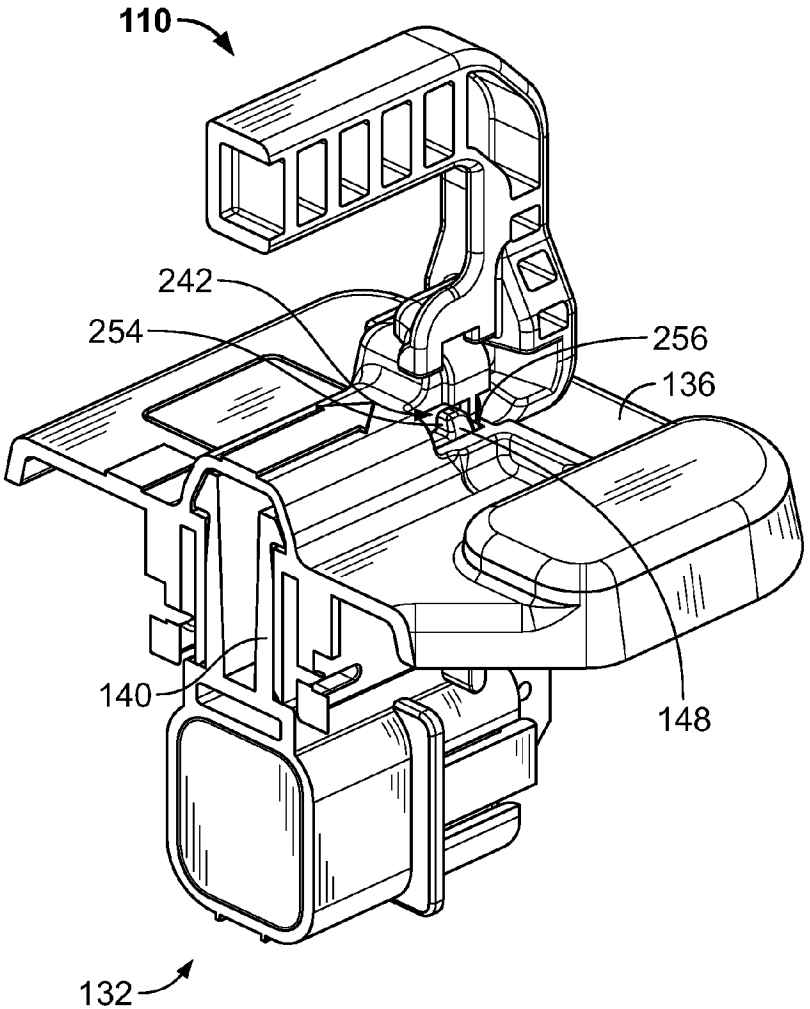
FIG. 5 is a partial cut-away view of the service disconnect assembly in an intermediate, lockable position.

In use, the service disconnect cover 136 is moved in a sliding direction, shown by the arrow B in FIG. 4, from an initial position, such as the position illustrated in FIG. 4, to a final position, such as the position illustrated in FIG. 5. During sliding, the service disconnect cover 136 is moved such that one of the attachment fingers 140 is aligned with the window 242.

FIG. 5 is a partial cut-away view of the service disconnect assembly 110 in an intermediate, lockable position. FIG. 5 illustrates an exemplary position of the service disconnect cover 136 with respect to the fuse carrier 132. As illustrated in FIG. 5, in the lockable position, the service disconnect cover 136 has been moved to a final position in which one of the attachment fingers 140 is aligned with the window 242. In an exemplary embodiment the attachment finger 140 having the peg 148 is positioned such that the peg 148 is aligned with the window 242. The peg 148 extends upward from the surrounding portion of the top of the attachment finger 140 to define a first end 254 and a second end 256. In the illustrated embodiment, the first end 254 is the front end of the peg 148 and the second end 256 is the rear end of the peg 148.

FIG. 6 is a perspective view of a portion of the service disconnect assembly 110 with the service disconnect cover removed and with the handle 138 in a locked position. The handle 138 is rotated in a locking direction, shown by an arrow C in FIG. 6, from the unlocked position, such as the position shown in FIG. 5, to the locked position. In the locked position, the handle 138 locks the service disconnect cover 136 (shown in FIG. 2) in position relative to the fuse carrier 132. For example, in the locked position, the catch 250 and the peg 148 are aligned with one another along the sliding direction such that the peg 148 blocks sliding of the catch 250. Optionally, when the handle 138 is in the locked position and prior to the service disconnect cover 136 being slid to the final position, the catch 250 may block the sliding of the service disconnect cover 136. For example, the exterior of the catch 250 may engage the second end 256 of the peg 148 to prevent movement of the service disconnect cover 136 to the final position when the handle 138 is in the locked position.

In an exemplary embodiment, the catch 250 receives the peg 148 when the handle 138 is in the locked position. For example, at least a portion of the peg 148 extends into the cavity formed by the catch 250. The finger engagement surface 252 of the catch 250 is configured to engage the first end 254 of the peg 148 to resist movement of the handle 138, and thus the service disconnect cover 136, with respect to the fuse carrier 132. As such, with the catch 250 aligned with the peg 148, the peg 148 blocks movement of the service disconnect cover 136 from the final position back to the initial position.

An exemplary assembly operation will be described below with reference to FIGS. 7-11. The assembly operation includes the loading operation of loading the fuse 108 into the fuse cavity 114. The assembly operation also includes the locking operation of locking the service disconnect cover 136 to the module cover 112 and locking the fuse carrier 132 to the service disconnect cover 136. In an exemplary embodiment, the service disconnect assembly 110 is coupled to the module cover 112 in a multi-step mating operation that incorporates loading the service disconnect assembly 110 in a primary loading direction and then moving the service disconnect cover 136 in a sliding direction that is transverse to the loading direction. The multi-step mating is a safer mating operation than a single step mating, such as by only moving the service disconnect assembly 110 in a single direction. The multi-step mating generally requires a conscious action by an operator to unlock the service disconnect assembly 110 from the module cover 112 which reducing the possibility of inadvertent removal.

Figure 7:
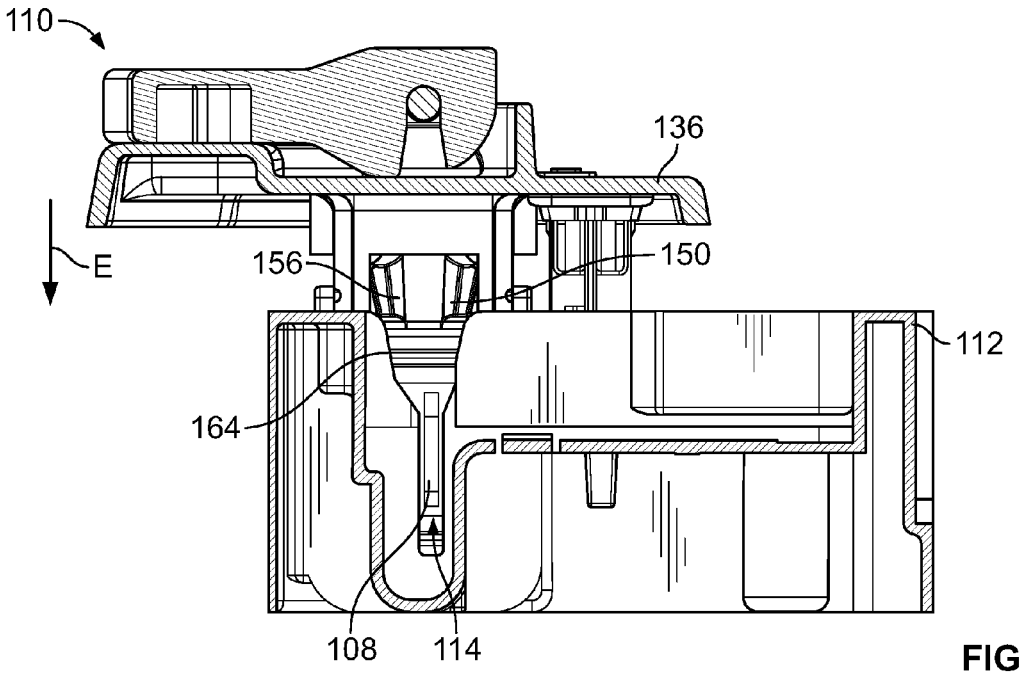
FIG. 7 is a side cross-sectional view of the service disconnect assembly in a first stage.
Figure 8:
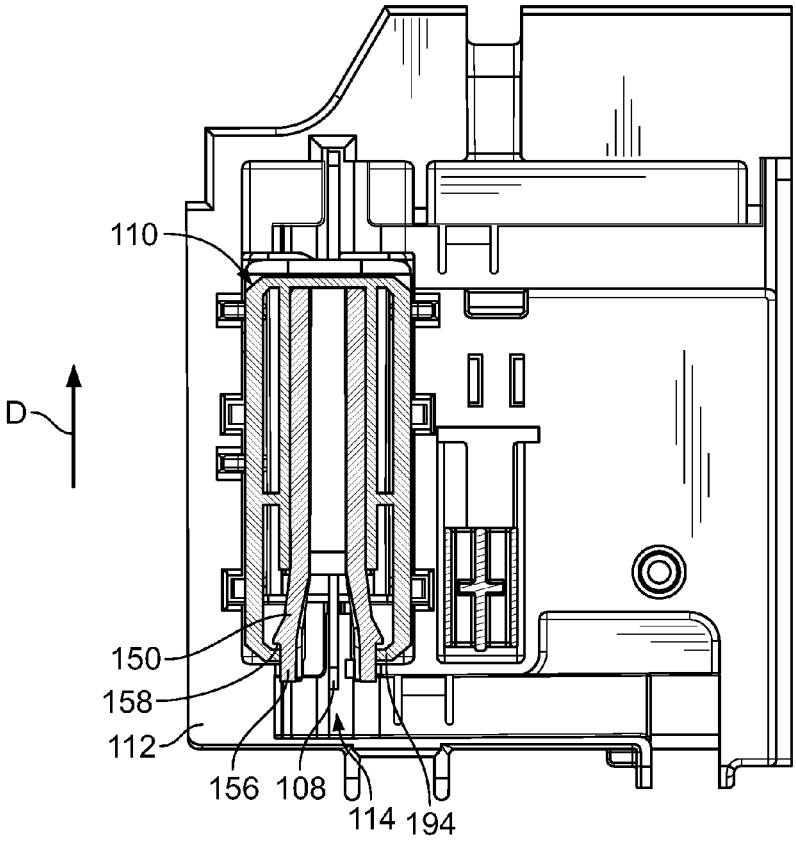
FIG. 8 is a top cross-sectional view of the service disconnect assembly in the first stage.

FIGS. 7 and 8 are side and top cross-sectional views, respectively, of the service disconnect assembly 110 in a first stage of assembly. In the first stage of assembly, the service disconnect assembly 110 is aligned with the module cover 112 and the fuse 108 may be partially loaded into the fuse chamber 114. As illustrated in FIG. 7, the tips 156 of the alignment fingers 150 are positioned proximate to the ramp surfaces 164, however, the alignment fingers 150 are not deflected by the ramp surfaces 164 in the first stage of assembly. As illustrated in FIG. 8, the alignment fingers 150 are in a blocking position such that the catch surfaces 158 are aligned with the rear end wall 194. The service disconnect cover 136 is unable to move in a sliding direction, shown in FIG. 8 by the arrow D, when the alignment fingers 150 are in the blocking position. During assembly, the service disconnect assembly 110 is moved from the first stage of assembly to a second stage of assembly, such as the stage shown in FIGS. 9 and 10, by moving the service disconnect assembly 110 in a seating direction, shown in FIG. 7 by the arrow E, to a seated position in which the fuse 108 is loaded into the module cover 112.

Figure 9:
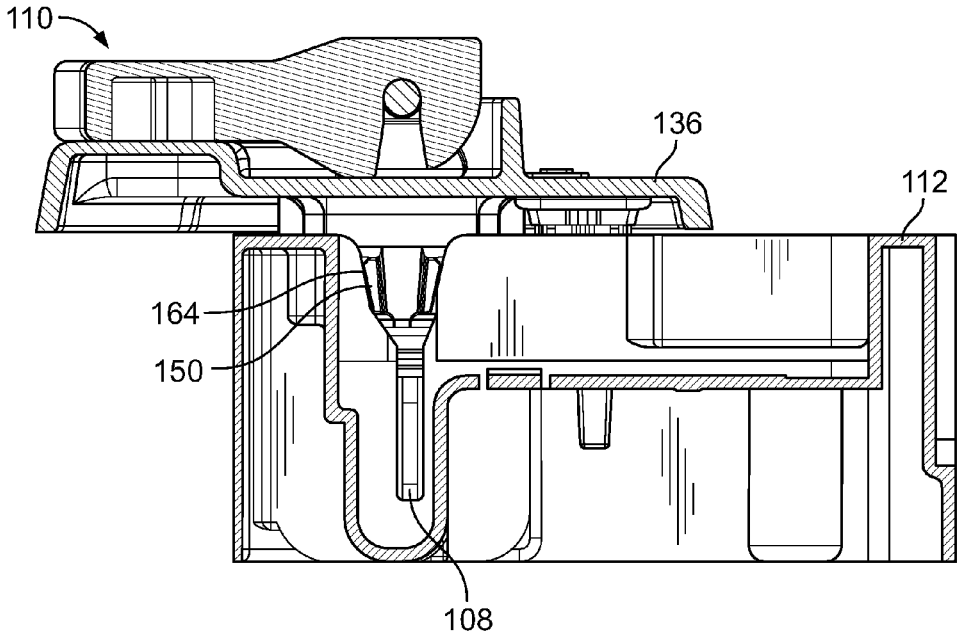
FIG. 9 is a side cross-sectional view of the service disconnect assembly in a second stage.
Figure 10:
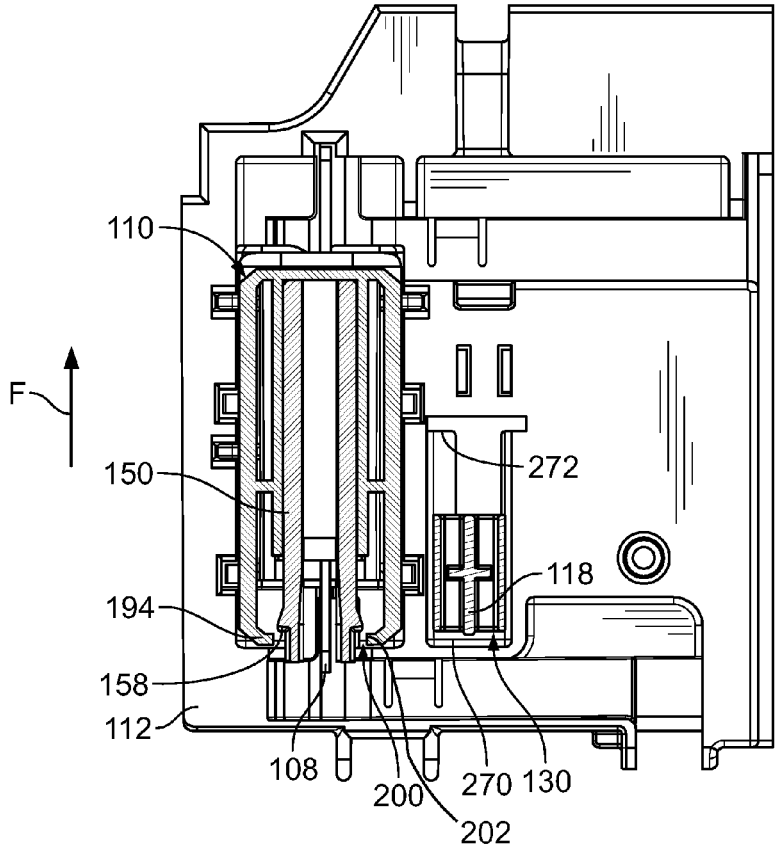
FIG. 10 is a top cross-sectional view of the service disconnect assembly in the second stage.

FIGS. 9 and 10 are side and top cross-sectional views, respectively, of the service disconnect assembly 110 in the second stage of assembly. In the second stage of assembly, the service disconnect assembly 110 is mated with the module cover 112 such that the fuse 108 is in a final position and is connected to the circuit. In an exemplary embodiment, the service disconnect assembly 110 is loaded in the loading direction until the service disconnect cover 136 engages the module cover 112. As illustrated in FIG. 9, the alignment fingers 150 engage the ramp surfaces 164 and are deflected inward toward one another to a clearance position.

As illustrated in FIG. 10, in the clearance position, the catch surfaces 158 are aligned with the opening 200 in the rear end wall 194. The end wall 194 is able to clear the catch surfaces 158 as the service disconnect cover 136 is moved in the sliding direction, shown in FIG. 10 by the arrow F, from the initial position, such as the position shown in FIG. 10, to the final position, such as the position shown in FIG. 11. More specifically, when the alignment fingers 150 are deflected to the clearance position, the catch surfaces 158 fit between the edges 202 of the opening 200 to allow the service disconnect cover 136 to slide toward the final position. Optionally, when the alignment fingers 150 are in the clearance position, the alignment fingers 150 may be generally parallel to one another.

FIG. 10 further illustrates the high voltage interlock 118 loaded into the interlock chamber 130. The high voltage interlock 118 is positioned proximate to a first end 270 of the interlock chamber 130. The high voltage interlock 118 is movable within the interlock chamber 130 toward a second end 272 of the interlock chamber 130 when the service disconnect cover 136 is moved to the final position.

Figure 11:
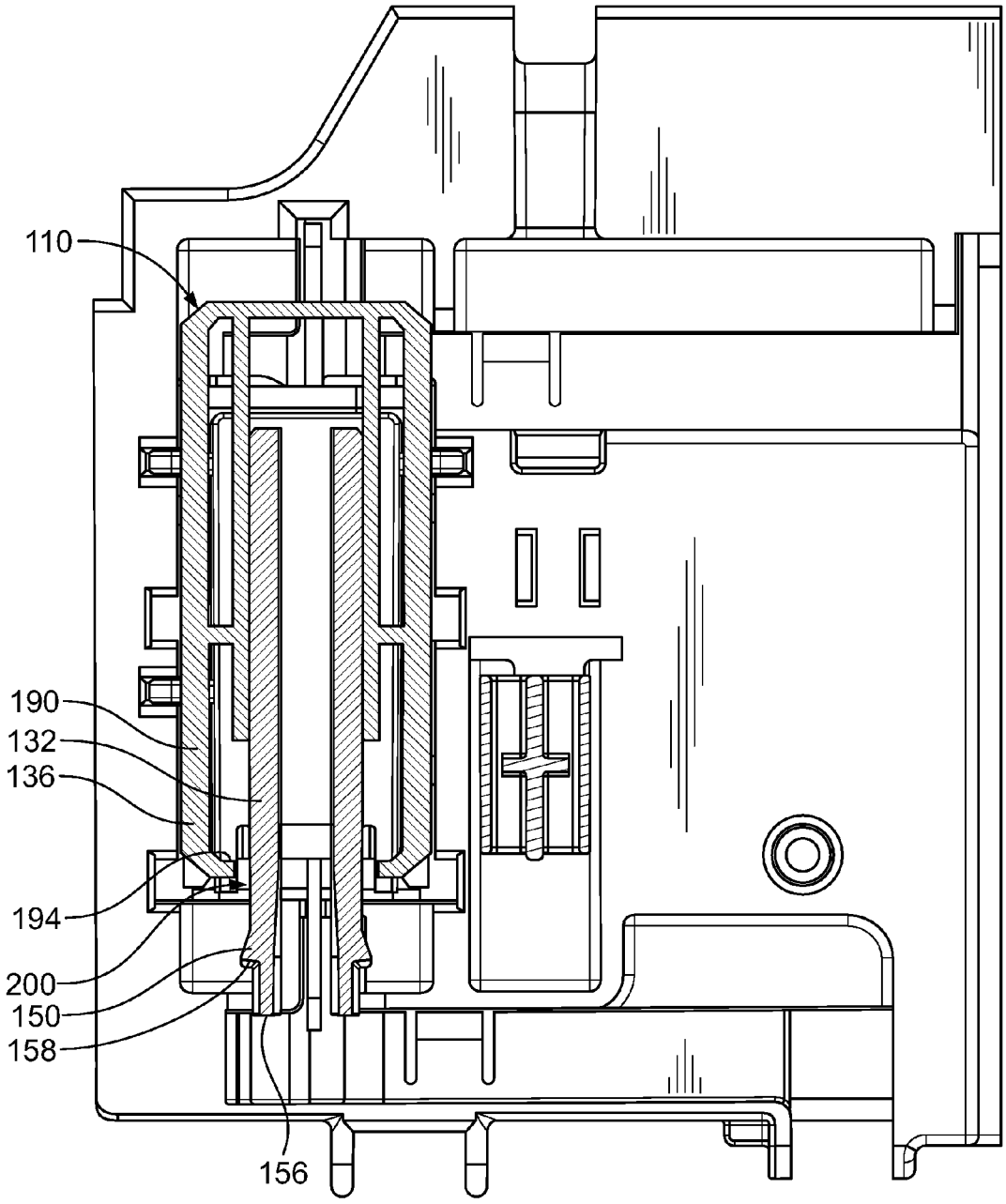
FIG. 11 is a top cross-sectional view of the service disconnect assembly in a third stage.

FIG. 11 is a top cross-sectional view of the service disconnect assembly 110 in a third stage of assembly. In the third stage of assembly, the service disconnect cover 136 is in the final position. The service disconnect cover 136 is moved from the initial position to the final position by sliding or otherwise transferring the service disconnect cover 136 relative to the fuse carrier 132. In the final position, the alignment fingers 150 extend through the opening 200 in the rear end plate 194 such that the catch surfaces 158 and the tips 156 are located outside of the mounting block 190.

A service disconnect assembly 110 is thus provided that allows a technician or operator to safely couple and uncouple the fuse 108 from the electronic module 100. The service disconnect assembly 110 includes a plurality of position assurance features that avoid unintentional removal of the fuse and/or interlock from the electronic module 100. The position assurance features allow for multi-step latching that employs separate and discrete, conscious movements by the operator to fully mate the service disconnect assembly 110 with the electronic module 100. For example, the service disconnect assembly 110 is loaded into the module cover 112 in a primary loading direction and then slid in a different direction to a locked position. The locking features 126 and locking fingers 206 define a position assurance feature that ensures that the service disconnect assembly 110 is locked or otherwise secured in position with respect to the module cover 112. The alignment fingers 150 and the ramp surfaces 164 define a position assurance feature that ensures that the fuse 108 is fully loaded into the fuse chamber 114 before the service disconnect cover 136 is able to move to the final position. The peg 148 of the attachment finger 140 and the catch 150 of the handle 138 cooperate to define a position assurance feature that ensures that the service disconnect cover 136 is locked or otherwise secured in position with respect to the fuse carrier 132.

It is to be understood that the above description is intended to be illustrative, and not restrictive. For example, the above-described embodiments (and/or aspects thereof), may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A service disconnect assembly for an electronic module comprising:

a fuse carrier having a holder configured to hold a fuse for the electronic module, the fuse carrier having an attachment finger extending from the holder, the attachment finger having a peg;

a service disconnect cover having a hood forming a channel, the hood having a window exposing a portion of the channel, the attachment finger received in the channel to couple the fuse carrier to the service disconnect cover, the service disconnect cover being slidable with respect to the fuse carrier between an initial position and a final position, wherein the hood moves with respect to the attachment finger as the service disconnect cover is moved between the initial and final positions, the peg being aligned with the window in the final position; and a handle rotatably coupled to the service disconnect cover, the handle having a catch aligned with the window, the handle being movable to a locked position wherein the catch blocks the peg to prevent relative movement between the service disconnect cover and the fuse carrier.

2. The service disconnect assembly of claim 1, wherein at least a portion of the handle is received in the channel through the window when the handle is in the locked position.

3. The service disconnect assembly of claim 1, wherein the peg extends from the attachment finger and includes a first end and a second end, the catch engaging the first end to prevent movement of the service disconnect cover in a direction from the final position to the initial position.

4. The service disconnect assembly of claim 3, wherein the catch engages the second end to prevent movement of the service disconnect cover to the final position when the handle is in the locked position.

5. The service disconnect assembly of claim 1, wherein the service disconnect cover is movable in a linear sliding direction relative to the fuse carrier, the catch being aligned with the peg in the sliding direction when the catch is in the locked position.

6. The service disconnect assembly of claim 1, wherein the channel extends longitudinal between opposed first and second ends, the attachment finger being positioned proximate to the second end when the service disconnect cover is in the initial position, and the attachment finger being positioned proximate to the first end when the service disconnect cover is in the final position.

7. The service disconnect assembly of claim 1, wherein the service disconnect cover includes an interior surface and an exterior surface, the channel provided along the interior surface, the handle coupled to the exterior surface, the service disconnect cover being coupled to the electronic module such that the fuse carrier is covered from the external environment by the service disconnect cover and the service disconnect module being coupled to the electronic module such that the handle is accessible from the external environment.

8. A service disconnect assembly for an electronic module comprising:

a fuse carrier having a holder configured to hold a fuse for the electronic module, the fuse carrier being receivable in a fuse chamber of the electronic module to electrically connect the fuse with the electronic module, the fuse carrier having alignment fingers each having a tip and a catch surface extending from the alignment fingers and positioned a distance from the respective tip, the tips of the alignment fingers being configured to engage ramp surfaces in the fuse chamber to flex the tips from a blocking position to a clearance position, the alignment fingers engaging the ramp surfaces as the fuse carrier is loaded into the fuse chamber;

a service disconnect cover having an end wall, the fuse carrier being coupled to the service disconnect cover, the service disconnect cover being slidable with respect to the fuse carrier between an initial position and a final position, wherein the catch surfaces of the alignment fingers catch the end wall to block movement of the service disconnect cover from the initial position to the final position when the tips are in the blocking position, and wherein the end wall is configured to clear the catch surfaces with the tips are in the clearance position.

9. The service disconnect assembly of claim 8, wherein the alignment fingers are normally splayed outward away from one another, the alignment fingers being flexed toward one another when the alignment fingers engage the ramp surfaces.

10. The service disconnect assembly of claim 8, wherein the end wall includes an opening defined by edges, the alignment fingers extend through the opening such that the tips face the edges and the catch surfaces engage the end wall, the tips being flexed toward one another to the clearance position where the catch surfaces fit between the edges of the opening.

11. The service disconnect assembly of claim 8, wherein the alignment fingers engage the ramp surfaces as the fuse carrier is loaded into the fuse chamber, the tips being moved to the clearance position when the fuse carrier is fully loaded into the fuse chamber.

12. The service disconnect assembly of claim 8, wherein the service disconnect cover includes a mounting block defined by the end wall and opposed side walls extending perpendicular to the end wall, the fuse carrier being coupled to the mounting block, the alignment fingers extend generally parallel to the side walls through an opening in the end wall.

13. The service disconnect assembly of claim 8, wherein the service disconnect module is slidable from the initial position to the final position when the tips are in the clearance position.

14. A service disconnect assembly for an electronic module comprising:

a module cover having a fuse chamber defined by chamber walls, the fuse chamber having an opening providing access to the fuse chamber, the module cover including a locking feature extending into the fuse-chamber from a respective chamber wall, the locking feature including a ramp facing away from the opening and forming a detention area;

a fuse carrier having a holder configured to hold a fuse for the electronic module, the fuse carrier being received in the fuse chamber to electrically connect the fuse with the electronic module; and a service disconnect cover having a mounting block, the fuse carrier coupled to the mounting block, the mounting block including a locking finger extending from the mounting block, the service disconnect cover being positioned adjacent the module cover such that the locking finger engages the locking feature, the service disconnect cover being movable with respect to the module cover between an initial position and a final position, wherein the locking finger slides along a ramp surface toward the detention area as the service disconnect cover is moved from the initial position to the final position, the locking finger being captured in the detention area by the ramp when the service disconnect cover is in the final position.

15. The service disconnect assembly of claim 14, wherein the locking finger is movable along the ramp in a first direction as the service disconnect cover is moved from the initial position to the final position, and wherein the locking finger is movable along the ramp in a second direction generally opposite to the first direction as the service disconnect cover is moved from the final position to the initial position.

16. The service disconnect assembly of claim 14, wherein the ramp includes first and second ramp surfaces meeting at a peak, the locking finger riding along the first and second ramp surfaces between the initial and final positions.

17. The service disconnect assembly of claim 16, wherein the ramp surfaces force the service disconnect cover along the respective ramp surface away from the peak to either the initial position or the final position absent active movement by an operator in the direction of either the initial position or the final position.

18. The service disconnect assembly of claim 14, wherein the mounting block includes a slot adjacent the locking finger, the slot allowing the locking finger to be movable relative to the mounting block in a flexing direction that is generally perpendicular to the direction of movement of the service disconnect cover.

19. The service disconnect assembly of claim 14, wherein the fuse carrier is coupled to the service disconnect cover such that the fuse carrier and the service disconnect cover are coupled to the module cover as a unit in a seating direction to a seated position, the service disconnect cover being moved in a sliding direction transverse to the seating direction to the final position.

20. The service disconnect assembly of claim 14, wherein the locking finger and the locking feature cooperate to define a bi-stable lock to ensure that the service disconnect cover is in one of the initial position or the final position relative to the module cover.

* * * * *